United States Patent [19]

Brown et al.

[11] 4,313,683

[45] Feb. 2, 1982

[54] MICROCOMPUTER CONTROL OF RIBBON DRIVE FOR PRINTERS

[75] Inventors: Earl T. Brown; Barry R. Cavill, both of Boca Raton, Fla.

[73] Assignee: International Business Machines Corporation, Armonk, N.Y.

[21] Appl. No.: 86,567

[22] Filed: Oct. 19, 1979

[51] Int. Cl.[3] ..... B41J 33/14

[52] U.S. Cl. ..... 400/225; 400/124; 400/219.1; 400/221; 400/234; 400/236.2; 400/248; 400/249; 400/616.2; 400/902

[58] Field of Search ..... 400/219, 219.1, 221, 400/222, 225, 229, 236.2, 249, 902

[56] References Cited

U.S. PATENT DOCUMENTS

| | | | |
|---|---|---|---|
| 3,291,043 | 12/1966 | Bernard | 400/219.1 X |
| 3,354,822 | 11/1967 | Dollot | 400/219.1 X |
| 3,496,547 | 2/1970 | Gorrill et al. | 400/219 X |
| 3,730,082 | 5/1973 | Perry | 400/225 X |
| 3,902,585 | 9/1975 | Mogtader | 400/219.1 |
| 3,966,036 | 6/1976 | Bernardis et al. | 400/219.1 |
| 3,974,906 | 8/1976 | Lee et al. | 400/902 X |
| 4,000,804 | 1/1977 | Zaltieri | 400/225 X |
| 4,025,830 | 5/1977 | Delaporte | 400/225 X |
| 4,091,913 | 5/1978 | Ku et al. | 400/225 X |
| 4,177,731 | 12/1979 | Kleist et al. | 400/219.1 X |

FOREIGN PATENT DOCUMENTS

| | | | |
|---|---|---|---|
| 2445260 | 4/1976 | Fed. Rep. of Germany | 400/219.1 |
| 2746059 | 4/1979 | Fed. Rep. of Germany | 400/249 |
| 1416295 | 12/1975 | United Kingdom | 400/219 |
| 1499152 | 1/1978 | United Kingdom | 400/219.1 |

*Primary Examiner*—Ernest T. Wright, Jr.
*Attorney, Agent, or Firm*—D. Kendall Cooper

[57] ABSTRACT

A microcomputer controls a ribbon drive assembly in a high speed wire matrix printer to eliminte ribbon slack, to insure proper ribbon positioning and to conduct diagnostics in conjunction with turning on the printer such as start-up time each day and after replacement of the ribbon with a new ribbon, the diagnostics checking to be sure that a ribbon is actually in the proper position, that it is threaded across the print line and also checking for proper operation of the ribbon drive, logic, and electronics. Tests are also made for proper ribbon drive during normal ribbon feeding operations.

9 Claims, 12 Drawing Figures

MICROCOMPUTER CONTROL OF RIBBON DRIVE FOR PRINTERS

BACKGROUND OF THE INVENTION

This invention relates to ribbon drive assemblies, but more particularly to control systems for eliminating ribbon slack in conjunction with automatic diagnostics. High speed printers, including wire matrix printers, that utilize inked ribbons many times encounter difficulties in controlling the ribbon motion and maintaining proper positioning and ribbon tension.

SUMMARY OF THE INVENTION

In accordance with the present invention, control means is provided in conjunction with a high speed wire matrix printer to insure removal of ribbon slack, to insure proper ribbon positioning and to conduct diagnostics in conjunction with turning on the printer such as at start-up time each day and after replacement of the ribbon with a new ribbon, the diagnostics checking to be sure that a ribbon is actually in the proper position, that it is threaded across the print line and also checking for proper operation of the ribbon drive, logic, and electronics.

CROSS-REFERENCE TO RELATED PATENT APPLICATIONS

The present patent application is one of a group of copending patent applications which describe the same overall printer subsystem configuration but which individually claim different inventive concepts embodied in such overall printer subsystem configuration. These related patent applications were filed on the same date, namely, Oct. 19, 1979. Two that are of particular interest are specifically incorporated by reference herein and are noted below:

(1) Application Ser. No. 086,484 entitled "Printer Subsystem with Microprocessor Control", the inventors being Messrs. William W. Boynton et al.; and (2) Application Ser. No. 086,568 entitled "Ribbon Shield for Printer", the inventor being Mr. Donald K. Rex.

For a better understanding of the present invention, together with other and further advantages and features thereof, reference is made to the following description taken in connection with the accompanying drawing, the scope of the invention being pointed out in the appended claims.

BRIEF DESCRIPTION OF THE DRAWING

Referring to the drawing.

DESCRIPTION OF PRINTER SUBSYSTEM AND PRINTER MECHANISMS

In order to best illustrate the utility of the present invention, it is described in conjunction with a high speed matrix printer, typically capable of printing in a high range of lines per minute on continuous forms.

Figure 1:
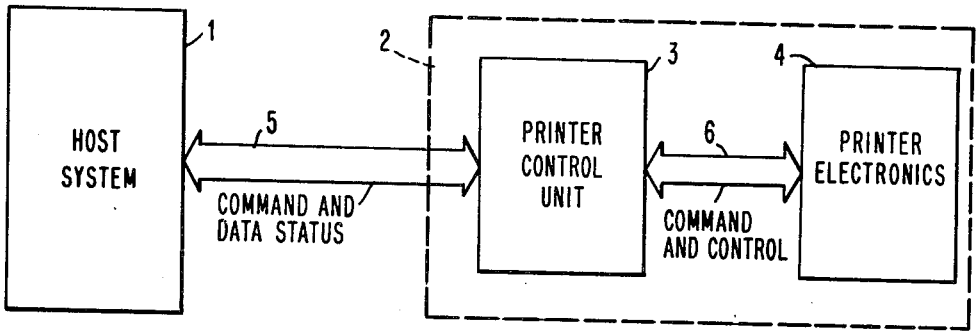
FIG. 1 is a simplified system diagram of the printer subsystem in which the invention is incorporated.

FIG. 1 illustrates a representative system configuration including a host system 1 and the printer subsystem 2 which includes a printer control unit 3 and printer electronics 4. Command and data signals are provided from the host system 1 by way of interface 5, and command and control signals are provided from printer control unit 3 to the printer electronics 4 way of bus 6. Status signals are supplied by printer control unit 3 to host system 1 by way of interface 5. Typically, the host system 1 generates information including commands and data, and monitors status. Printer control unit 3 receives the commands and data, decodes the commands, checks for errors and generates status information, controls printing and spacing, and conducts printer diagnostics. Printer electronics 4 executes decoded control unit commands, monitors all printer operations, activates print wires, drives motors, senses printer emitters, and controls operator panel lights and switching circuitry. It controls the tractor/platen mechanism, the ribbon drive, the print head (i.e., actuator group) carrier 31, the operator panel 26, and the printer sensors.

The elements of the system, such as the printer control unit 3 and printer electronics 4, incorporate one or more microprocessors or microcomputers to analyze commands and data and to control operations.

Figure 2:
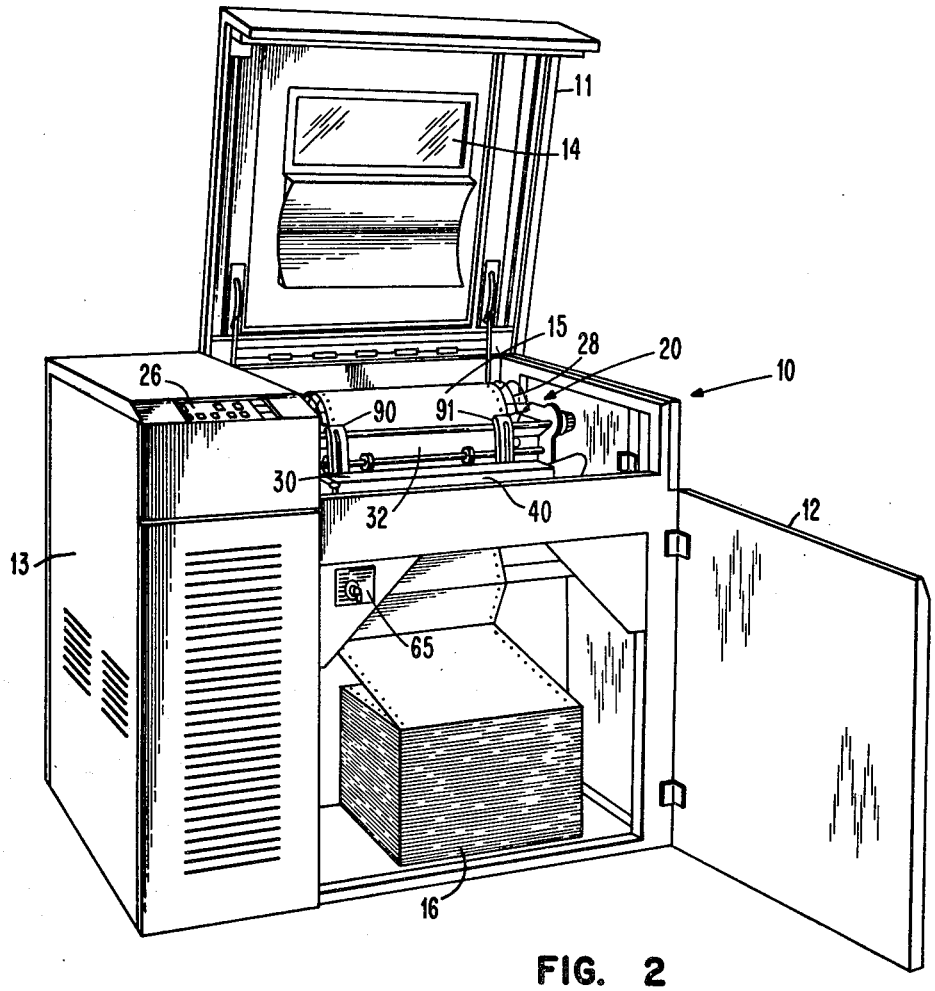
FIG. 2 illustrates the printer console having a number of printer components including forms feeding.
Figure 3:
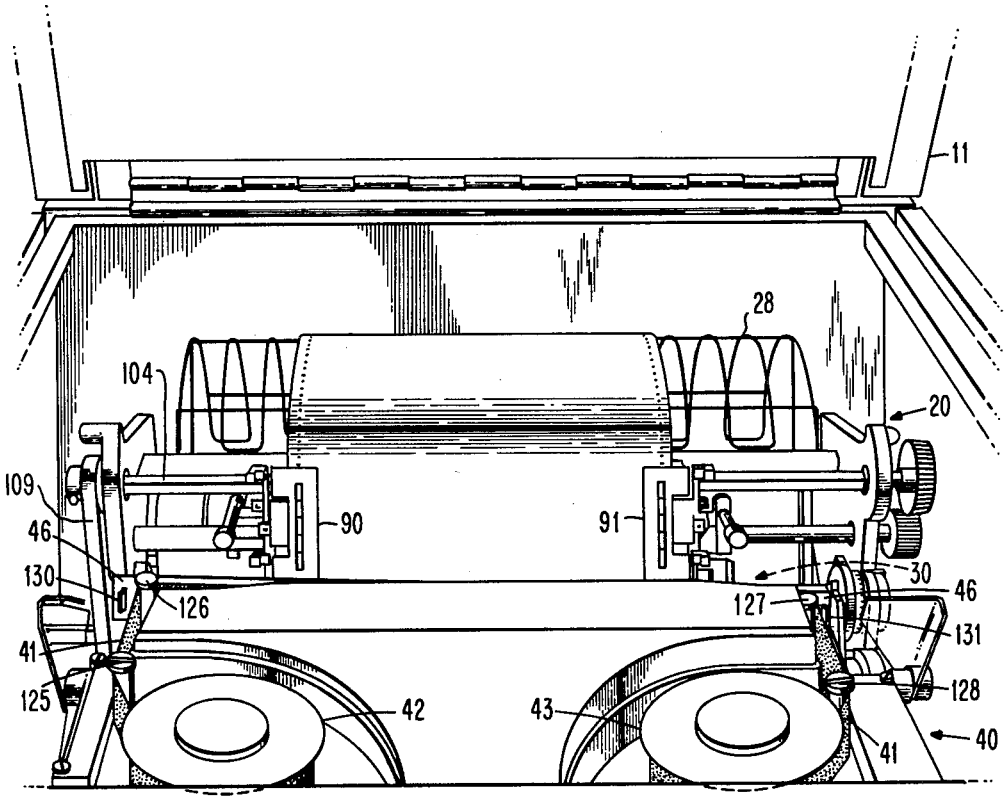
FIG. 3 is a frontal view of the printer.

FIGS. 2 and 3 illustrate various components of the printer all of which are housed in the console 10. Various access panels or covers such as those designated 11, 12, and 13 are provided. Top cover 11 has a window 14 that enables an operator to observe forms movement during operation of the printer and when the top cover 11 is closed. Forms (documents) 15 are provided from a stack 16 and can be fed in one embodiment upwardly or downwardly as viewed in FIGS. 2 and 3 by means of a forms feed assembly 20 which includes one or more sets of forms tractors such as the upper set comprising tractors 90 and 91. A forms guide 28 guides the forms 15 after printing to a takeup stack, not shown, but positioned below the printing mechanism and to the rear of the printer console 10. The printer incorporates a print assembly 30 that is positioned generally in a horizontal relationship with respect to forms 15 at a print station 32. Print assembly 30 is more clearly visible in other views. This is also true of the printer ribbon drive assembly 40 which is located in closer proximity to the front of the printer. Printer control unit 3 and its associated microprocessors are generally located behind the side cover 13.

A ribbon 41 is provided on one of the spools 42 or 43, which are disposable. Each box of ribbons would preferably contain a disposable ribbon shield 46 that fits between print assembly 30 and forms 15 to keep ribbon 41 in proper alignment and to minimize ink smudging on forms 15. Two motors 49 and 50 (FIG. 4) drive ribbon 41 back and forth between spools 42 and 43. The printer control unit 3 detects ribbon jams and end-of-ribbon (EOR) conditions. A ribbon jam turns on an error indicator and stops printing. An EOR condition reverses the ribbon drive direction.

The printer includes an operator panel 26 (shown and described in greater detail in the Boynton et al application) that consists of several operator control keys, two indicator lights, a power on/off switch, and an operator panel display.

A 16-position mode switch 65 (shown and described in the Boynton et al application) has an on-line position that permits printing to be controlled by the using system. All other positions are off-line and do not allow printing to be initiated from the using system.

OVERVIEW OF PRINTER MECHANISMS

FIGS. 4–7 show details of construction of the forms feed assembly 20, print assembly 30, and ribbon drive assembly 40.

Forms feed assembly 20 has end plates (side castings) 21 and 22 which support the various forms feed mechanisms including a drive motor 23 to drive tractors 90–93 through timing belt 109 and a platen 29 located behind the forms 15 and against which the print wires 33 are actuated during printing. Motor 23 has a forms feed emitter assembly 24 and there is a separate end of forms and jam detector emitter 25.

The print assembly 30 includes a base casting 75 supporting various mechanisms including print motor 76, shown in phantom in order that other elements may be seen more easily, and connected to drive a print head carrier 31 with actuator block assembly 77 in a reciprocal fashion horizontally to effect printing on an inserted form 15. The print assembly 30 also drives a print emitter 70 having an emitter glass 71 and an optical sensor assembly 72.

The ribbon drive assembly 40 includes a support casting 44, a cover 45, and drive motors 49 and 50.

FORMS FEED ASSEMBLY

In order to load paper in the printer the forms feed assembly 20 pivots away from the base casting 75 at pivot points 80 (80') and 81 (81') to allow access to thread the paper into position. Latches 83 and 84 are raised by the operator so that extremities **83*a* and 84*a* disengage eccentric pins 85 and 86 on the forms feed assembly 20. The forms feed assembly 20 then pivots away from the operator as viewed in FIGS. 3 and 4. This allows access to the tractors 90–93** so that the operator may load paper.

The forms feed assembly 20 is then reclosed and relatched by latches 83 and 84 for normal machine operation. During the time that the forms feed assembly 20 is pivoted back for sevice, a switch 94 prevents machine operation. Switch 94 is actuated by a tang 95 on the forms feed assembly 20 when it is closed.

Figure 4:
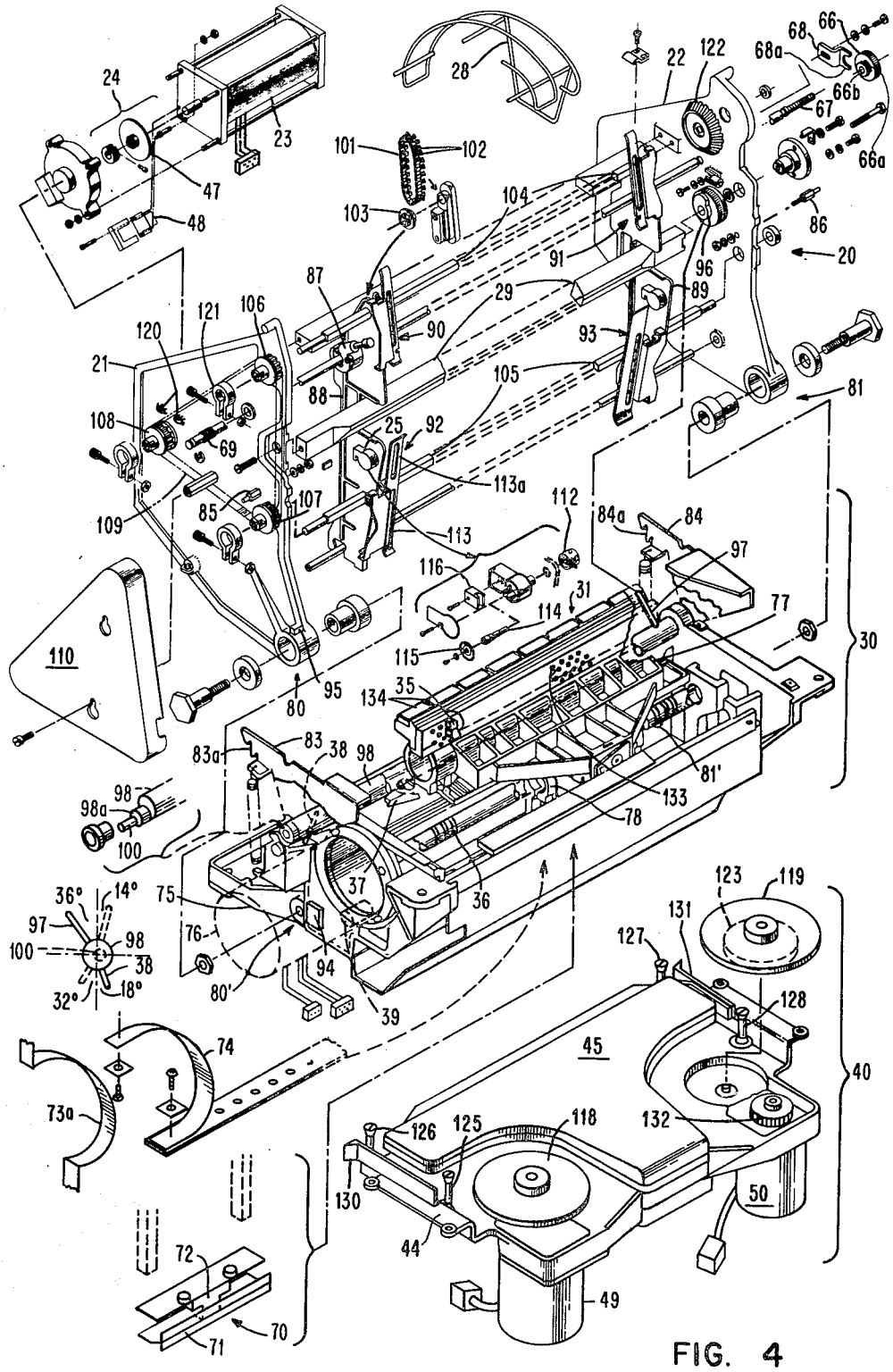
FIG. 4 is an exploded view of various printer assemblies including the forms feed assembly, the print assembly, and the ribbon drive assembly.
Figures 5, 6, 7:
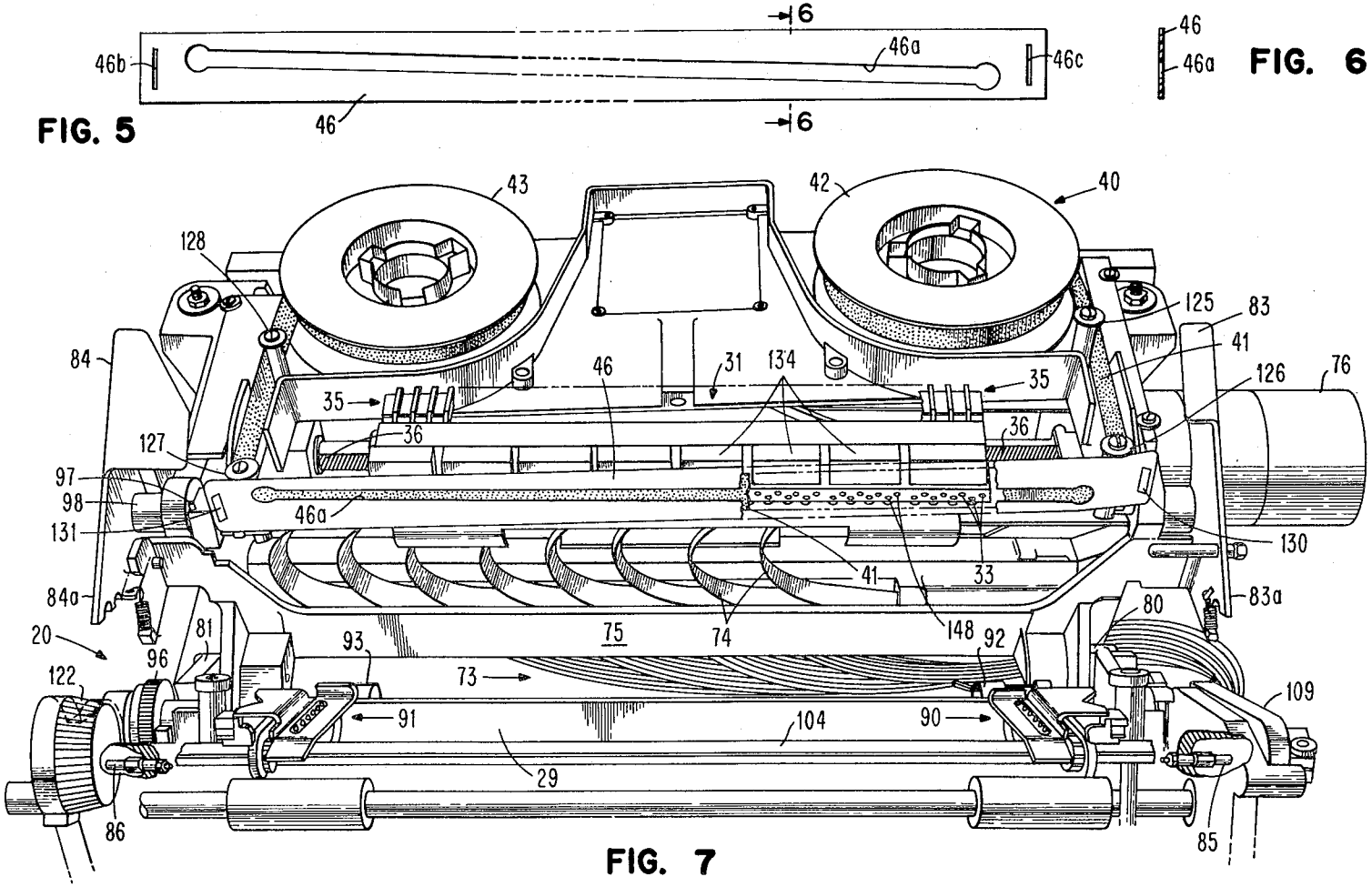
FIGS. 5 and 6 illustrate a ribbon shield that is useful in the printer.
FIG. 7 is an overhead view of the printer slightly from the rear of the unit showing the forms feed assembly open.

Referring to FIGS. 4 and 7, the forms feed assembly 20 includes means for adjusting for forms thickness. As mentioned, the entire forms feed assembly 20 pivots back from the rest of the printer about pivot points 80 and 81. In the closed position the forms feed assembly 20 is in such a position that a spiral cam and knob assembly 96 engages a pin 97 on the main carrier shaft 98 of the print assembly 30. Adjustment of the spiral cam and knob assembly 96 is such that it rotates the main carrier shaft 98. Assembly 96 is retained in a position selected by the operator by a spring loaded detent assembly not shown. Associated with shaft 98 are eccentrics such as portions **98*a* on the left end of shaft 98 with tenon 100 onto which latch 83 is mounted. Rotation of shaft 98 thus moves latches 83 and 84 which changes the distance between assemblies 20 and 30 and thus the distance between the ends of print wires 33 and platen 29. This adjustment enables the printer to accommodate forms 15 of various thicknesses. The printer can handle forms 15** from one part to six parts thickness.

The paper feeding is accomplished by the four sets of tractors 90–93 two above the print line and two below the print line. The individual tractors 90–93 include drive chains to which pins are attached at the proper distance to engage the holes in the form 15. As an example, tractor 90 has drive chain 101 with pins 102. Chain 101 is driven by a sprocket 103 attached to a shaft 104 which also drives the sprocket and chains for tractor 91. Tractors 92 and 93 are driven from shaft 105. Because the tractors 90–93 are above and below the print line, the printer is able to move the paper in either direction. The normal direction of forms drive is upwardly in FIGS. 3 and 4. However, it is possible to move the paper downwardly, as well.

Rotation of shafts 104 and 105 and forms feeding is accomplished by appropriate drive of motor 23 in the proper direction which in turn drives pulleys 106 and 107 (to which shafts 104 and 105 are connected) from motor pulley 108 by means of drive-timing belt 109. Cover 110 covers belt 109 and pulleys 106–108 during rotation. The forms feed emitter assembly 24 includes an emitter wheel 47 with marks to indicate rotation and a light emitting diode assembly 48 that serve to indicate extent of rotation of motor 23 in either direction and as a consequence, the extent of movement of the forms 15 as they are driven by motor 23.

The capability of the printer to feed paper in both directions offers some advantages. For example, in order to improve print visibility at the time the Stop pushbutton (one of pushbuttons on operator panel 26) is depressed by the operator, the paper may be moved up one or two inches above where it normally resides so that it can be easily read and can be easily adjusted for registration. When the Start pushbutton (one of pushbuttons on operator panel 26) is depressed, the paper is returned to its normal printing position back out of view of the operator. The printer may also be used in those applications where plotting is a requirement. In this case a plot may be generated by calculating one point at a time and moving the paper up and down much like a plotter rather than calculating the entire curve and printing it out from top to bottom in a raster mode.

End of forms and jam detection is accomplished by assembly 25 having a sprocket 112 just above the lower left tractor 92. The teeth in sprocket 112 protrude through a slot **113*a* in the flip cover 113. Sprocket 112 is not driven by any mechanism but simply is supported by a bearing that is part of assembly 25. The sprocket 112 engages the feed holes in the paper as it is pulled past by the tractor assemblies. On the other end of the shaft 114 from sprocket 112 is a small optical emitter disc 115. The marks in disc 115 are sensed by an LED phototransistor assembly 116 and supplied to electronics 4 of the subsystem 2. Electronics 4 verifies that marks have passed the phototransistor assembly 116** at some preselected frequency when the paper is being fed. If the mark is not sensed during that time, the machine is shut down as either the end of forms has occurred or a paper jam has occurred.

The castings 88 and 89 supporting the tractors 90–93 are adjustable left or right in a coarse adjustment in order to adjust for the paper size used in a particular application. After they are properly positioned they are locked in place on shaft 67 by locking screws such as locking screw 87.

All tractors 90–93 are driven by the two shafts 104 and 105 from motor 23 as previously described. Motor 23 adjusts in the side casting 21 in slots 120 in order to provide the correct tension for belt 109.

Besides the coarse adjustment, there is also a fine adjustment which is used to finally position in very small increments laterally the location of the printing on forms 15. This is done by a threaded knob 66 which engages shaft 67 to which both tractor castings are clamped by way of locking screw 87, for example. Shaft 67 floats between side castings 21 and 22 laterally. The threads in knob 66 engage threads on the right end of shaft 67. Knob 66 is held in an axially fixed position by a fork 68, the fork portion **68*a* engaging notch 66*a* formed by the flanged portion 66*b* of knob 66. Therefore knob 66 stays axially stationary and the threads driving through the shaft 67 force it laterally left or right, depending upon the direction in which knob 66 is rotated. Shaft 67 is always biased in one direction to take out play by a spring 69 on the left end of the shaft 67. As the forms 15 leave the top of the tractors 90, 91, they are guided up and toward the back of the machine and down by wire guide 28**.

In order to insure that the distance between the pins 102 in the upper tractors 90, 91 is in correct relationship to the pins 102 in the lower tractors 92, 93 an adjustment is performed. This adjustment is made by inserting a gauge or piece of paper, not shown, in the tractor assembly which locates the bottom pins 102 in the correct relationship to the top pins 102. This is done by loosening a clamp 121 on the end of shaft 104. Once this position is obtained, then clamp 121 is tightened and in effect phases the top set of tractors 90, 91 to the bottom set 92, 93 so that holes in the paper will engage both sets of tractors 90, 91 and 92, 93 correctly. Forms 15 may be moved through the tractor forms feed mechanism manually by rotating knob 122. This knob 122 simply engages the top drive shaft 104 of the upper tractor set and through the timing belt 109 (also shown in FIG. 7) provides rotational action to the lower tractor set, as well.

PRINT ASSEMBLY

In FIGS. 4 and 7, print assembly 30 comprising a carrier 31, an actuator block assembly 77 and support 78 accommodates all the print heads 134 with their wire actuators 35 and print wires 33. Assembly 30 is structured to hold from two up to eight or nine print head groups of eight actuators 35 each. Thus, a printer with eight print head groups, as shown in FIGS. 4 and 7, has sixty-four print wire actuators 35 and sixty-four associated print wires 33. Print wires 33 project through apertures 148, FIG. 7. Only two actuators 35 are shown positioned in place in FIG. 4. The other sixty-two actuators 35 would be located in apertures 133, only a few of which are depicted. To insure long life of the print wires 33, lubricating assemblies containing oil wicks, not shown, are positioned in proximity to the print wires 33. The print wire actuators 35 fire the wires 33 to print dots to form characters. Carrier 31 is engaged with and is shuttled back and forth by a lead screw 36 driven by motor 76. Motor 76 is a brushless DC motor. For commutation purposes, a Hall effect emitter 39 provides a signal to the printer control unit 3 to indicate when it is time to change from one winding to the next. When carrier 31 is located at the extreme left as viewed in FIG. 4 (to the right as viewed in FIG. 7), this is called the "home" position. When carrier 31 is moved to the home position, a cam 37 attached to the carrier 31 engages a pin 38, the pin 38 being attached to the main carrier shaft 98. If the machine has not been printing for some period of time, in the neighborhood of a few seconds, the printer control unit 3 signals the carrier 31 to move all the way to the left, in which case cam 37 engages pin 38 to rotate the main carrier shaft 98 approximately 15 degrees. The maximum rotation of shaft 98 is about 50° shown for pin 97 as $36°+14°=50°$ and for pin 38 as $32°+18°=50°$. On each end of the shaft 98 are the eccentrically located tenons, such as tenon 100, previously described. Tenons, such as tenon 100, engage the latches 83 and 84 so that the distance between the print assembly 30 and the forms feed assembly 20 is controlled by the latches 83 and 84. As shaft 98 rotates, the eccentrically located tenons such as tenon 100, associated with latches 83 and 84 separate the forms feed assembly 20 from the print assembly 30.

The current necessary to fire the print wire actuators 35 is carried to the actuators 35 via the cable assemblies 73, FIGS. 4 and 7, one for each group of eight actuators 35. The cabling, such as cable assembly **73*a*, FIG. 4, is set in the machine in a semicircular loop so that as carrier 31 reciprocates it allows the cable 73*a* to roll about a radius and therefore not put excessive stress on the cable wires. This loop in the cable 73*a* is formed and held in shape by a steel backing strap 74. In this case there is one cable assembly, such as assembly 73*a*, for each group of eight actuators 35** or a maximum of eight cable backing strap groups on each machine.

RIBBON DRIVE ASSEMBLY

The ribbon drive assembly 40 for the printer is shown in FIGS. 3, 4 and 7 primarily. Spools 42 and 43 which contain the ribbon 41 can be seen on either side of the machine near the front, FIG. 3 and are respectively driven by stepper motors 49 and 50. Spools 42 and 43 typically contain 150 yards of nylon ribbon 41 that is one and a half inches wide. Gear flanges 118 and 119, FIG. 4. support ribbon spools 42 and 43, respectively. Drive for spool 43, as an example, is from motor 50, pinion gear 132 to a matching gear 123 formed on the underneath side of gear flange 119 then to spool 43. In one direction of feed, the ribbon path is from the left-hand spool 42 past posts 125 and 126, FIGS. 3, 4 and 7 across the front of the ribbon drive assembly 40 between the print heads 134 and forms 15, then past posts 127 and 128 back to the right-hand ribbon spool 43. The ribbon shield 46 is generally located between posts 126 and 127 and is mounted on the two attachment spring members 130 and 131.

RIBBON SHIELD

FIG. 5 illustrates a ribbon shield 46 that is particularly useful in the printer of FIGS. 3, 4 and 7. FIG. 6 is a cross-sectional view along the line 6—6 in FIG. 5. Shield 46 has an elongated aperture **46*a* extending almost its entire length. The aperture 46*a* enables the print wires 33 to press against the ribbon 41 in the printer through the shield 46 in order to print on forms 15**.

Shield 46 has slits 46b and 46c at opposite extremities to permit easy mounting in the printer on spring members 130 and 131 of the ribbon drive assembly 40, FIGS. 3, 4 and 7. Shield 46 and ribbon 41 are illustrated slightly on the bias in FIGS. 5 and 7 which is their more normal relationship in the printer. The ribbon drive assembly 40 is also positioned on a slight bias relative to horizontal to accommodate the bias of shield 46 and ribbon 41. In this condition aperture 46a assumes a horizontal relationship with respect to the print wires 33 and forms 15.

PRINTING OF CHARACTERS

Characters that are printed are formed by printing dots on the paper. These dots are printed by wires 33 that are mounted in groups of eight on carrier 31 that moves back and forth adjacent to the print line. Printing is bidirectional with complete lines of print formed right-to-left and left-to-right.

A character is formed in a space that is eight dots high by nine dots wide. Two of the nine horizontal dot columns (1 and 9) are for spacing between characters. Any one wire 33 can print a dot in four of the seven remaining horizontal dot positions (2 through 8). The printer can print 10 characters per inch or 15 characters per inch.

Most of the characters printed use the top seven wires 33 in the group to print a character in a format (or matrix) that is seven dots high and seven dots wide. The eighth (bottom) wire 33 is used for certain lower case characters, special characters, and underlining.

The number of print wire groups varies according to the printer model, and typically can be 2, 4, 6 or 8 groups. Printing speed increases with additional wire groups. There are, as an example, 16 character sets stored in the printer control unit 3. Any of these sets may be specified for use by the host system program.

PRINTER GENERAL BLOCK DIAGRAM

Figure 8:
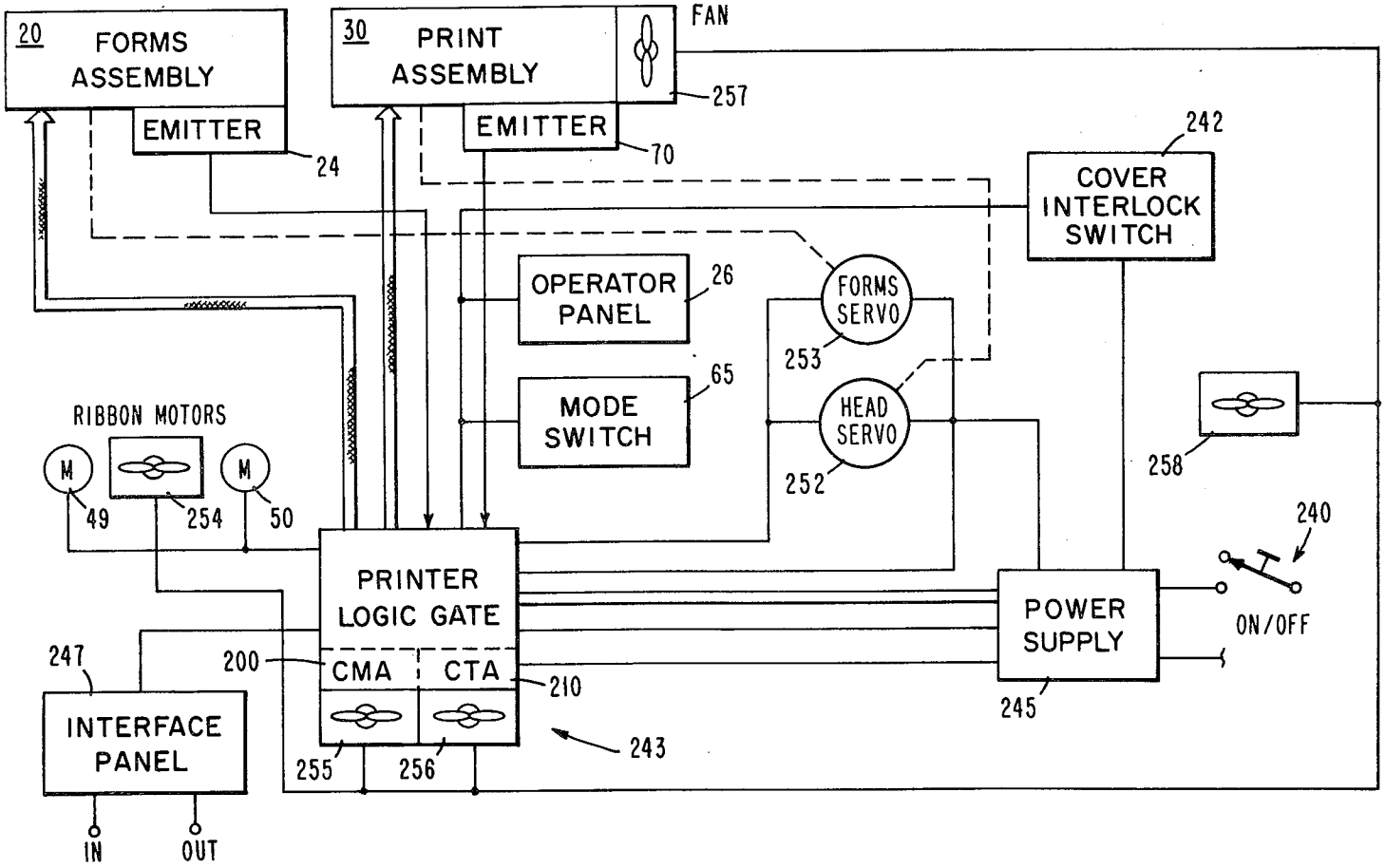
FIG. 8 shows a number of electrical components and control blocks for the printer subsystem.

FIG. 8 illustrates various printer blocks of interest. A power supply 245 supplies the unit with all the power to drive and to control. The on/off switch 240 controls power supply 245 being on and off. From the power supply 245 the cover interlock switch 242 enables and disables the 48-volt drive which controls much of the printer logic 243. Logic 243, once enabled, looks at operator panel 26 for information as to the operations to be performed. Mode switch 65 tells the logic 243 which type of operation in testing procedures should be run. Print assembly 30 is controlled by the printer logic 243 along with the forms assembly 20. Emitter devices 24 and 70 supply positional information to the printer logic 243. The printer logic 243 also controls and talks with the interface panel 247 and passes information on the other parts of the printer. The ribbon motors 49 and 50 are controlled in an on/off fashion by printer logic 243 which accepts inputs from the ribbon assembly 40 to determine when the end of ribbon 41 has occurred. Head servo 252 is a control block that insures that the print head 134 is in the proper position at the proper time for the actuators 35 to fire. Forms servo 253 is a control block that moves the forms 15 to desired locations. Fans 254–258 are used to control temperature within the machine. As described in the Boynton et al patent application, printer logic 243 includes two microprocessor adapter blocks 200 and 210. The first one included is the communications adapter CMA which accepts input and passes it to the second one which is the control adapter CTA that actually controls the printer.

DESCRIPTION OF RIBBON CONTROL AND DRIVE SYSTEM AND OPERATING MODES INCLUDING DIAGNOSTICS

The printer ribbon drive assembly 40 consists of the two stepper motors 49 and 50, FIGS. 4 and 8, driving ribbon 41 between the two spools 42 and 43. See also FIGS. 3 and 7. While one motor (49 or 50) drives the ribbon 41, the other motor (50 or 49) is being pulled, and generates a voltage in one of its phases. This voltage is detected and buffered to give an emitter signal, the frequency of occurrence of emitter signals being dependent on relative ribbon diameters, and typically occurring every 4 to 6 motor steps. A motor step is defined as 2° rotation of an individual motor 49 or 50. These emitter signals when present indicate that ribbon 41 is present on the spool (42 or 43) which is being pulled and that the ribbon 41 is moving. When the emitter signals stop, the motors 49 and 50 are reversed with the one that was being pulled now driving and the other motor (49 or 50) generating emitter signals. The criterion used to indicate turnaround is loss of emitter signals for a given number of motor steps of the driving motor (49 or 50).

Figure 9:
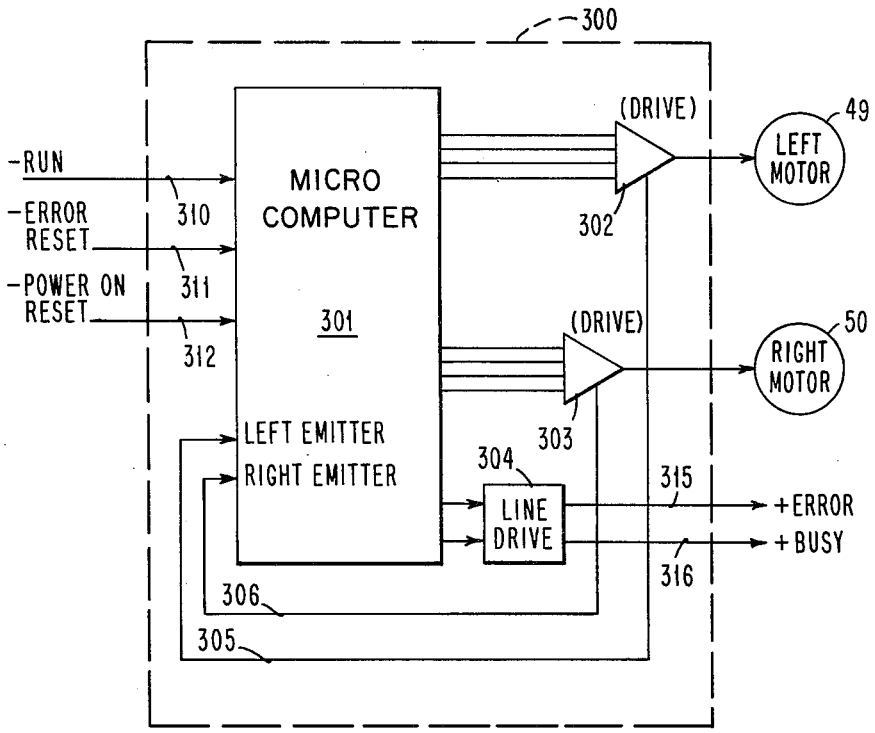
FIG. 9 illustrates a ribbon drive control circuit for the printer, the circuit utilizing a microcomputer.

FIG. 9 illustrates the Ribbon Drive Control block 300. Drive control block 300 comprises a microcomputer 301 outputting drive signals to analog drive stages 302 and 303 for the left and right motors 49 and 50, respectively.

The microcomputer 301 includes its own Read Only Storage, Random Access Memory, Interface and timers and may be any of a number of commercially available products of this nature. An example is the Intel 8748 EPROM microcomputer that incorporates an erasable programmable Read Only Memory. From drive stage 302 there is an emitter line 305 going back to microcomputer 301 and from drive stage 303 there is an emitter line 306 going back to microcomputer 301. When line 312, Power on Reset, is activated, block 300 becomes operational, line 315, +Error, becomes active and line 316, +Busy, becomes inactive. Before operation can begin, +Error line 315 is reset either by activating −Error Reset line 311 or by entering the diagnostic mode. Normal motion of the ribbon 41 is activated by turning on the −Run line 310. Block 304 is a Line Drive to improve the voltage going from Ribbon Drive Control block 300.

When the ribbon drive is first activated, there is a possible problem. The microcomputer 301 which drives the ribbon 41 assumes an initial direction for the motion. If this direction is such that there is no ribbon 41 on one of the feed spools 42 or 43, no emitter signals will occur on either line 305 or line 306 and the ribbon 41 will begin motion in the opposite direction. If there is a little slack in the ribbon 41, no emitter signals will again be received. This will cause a ribbon error and a signal is provided on line 315.

Figure 10:
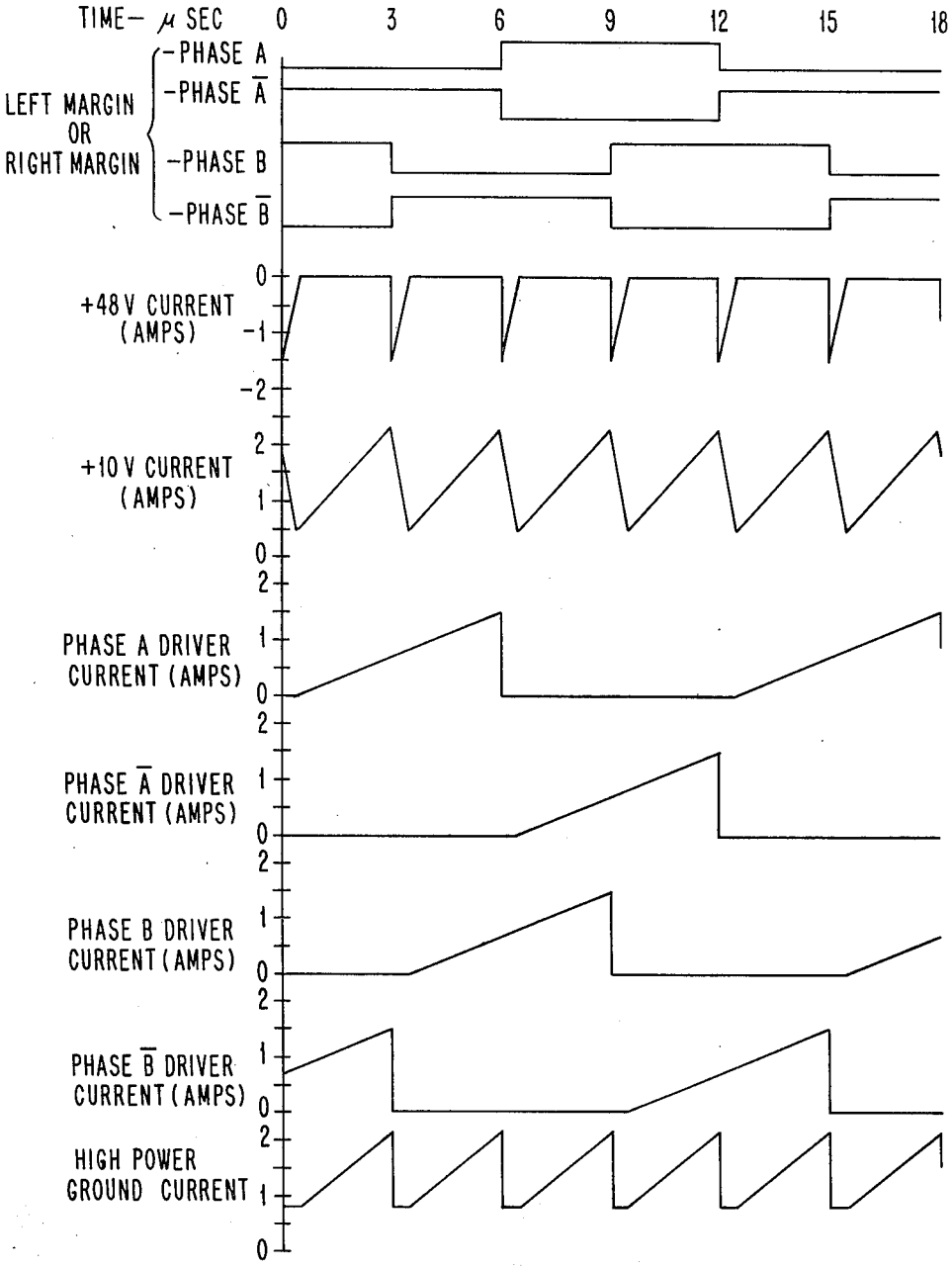
FIG. 10 shows some representative waveforms derived during operation of the ribbon drive motors.

FIG. 10 shows representative examples of waveforms for one of the motors 49 or 50 at different test points. The Phase A and Phase B signals are included. At each change of the motor phase, a current spike is developed on the +48-volt line. This current spike is caused by the changing of the phase and provides an initial 48-volt pulse to the motor (49 or 50) to cause it to move. A saw tooth sustaining current is also shown. The driver current in the different motors 49 or 50 increases in a repeating pattern. These are shown as half a saw tooth waveform with a flat in the middle. This is because the driver current increases as it comes closer to the poles on the motor 49 or 50. The High Power ground current through the motor 49 or 50 changes as shown with each motor phase change. The induced feedback waveforms are not shown in FIG. 10, but they are a lower level signal, measured in tens of millivolts.

RIBBON DIAGNOSTIC MOTION AND SLACK REMOVAL

Figure 11:
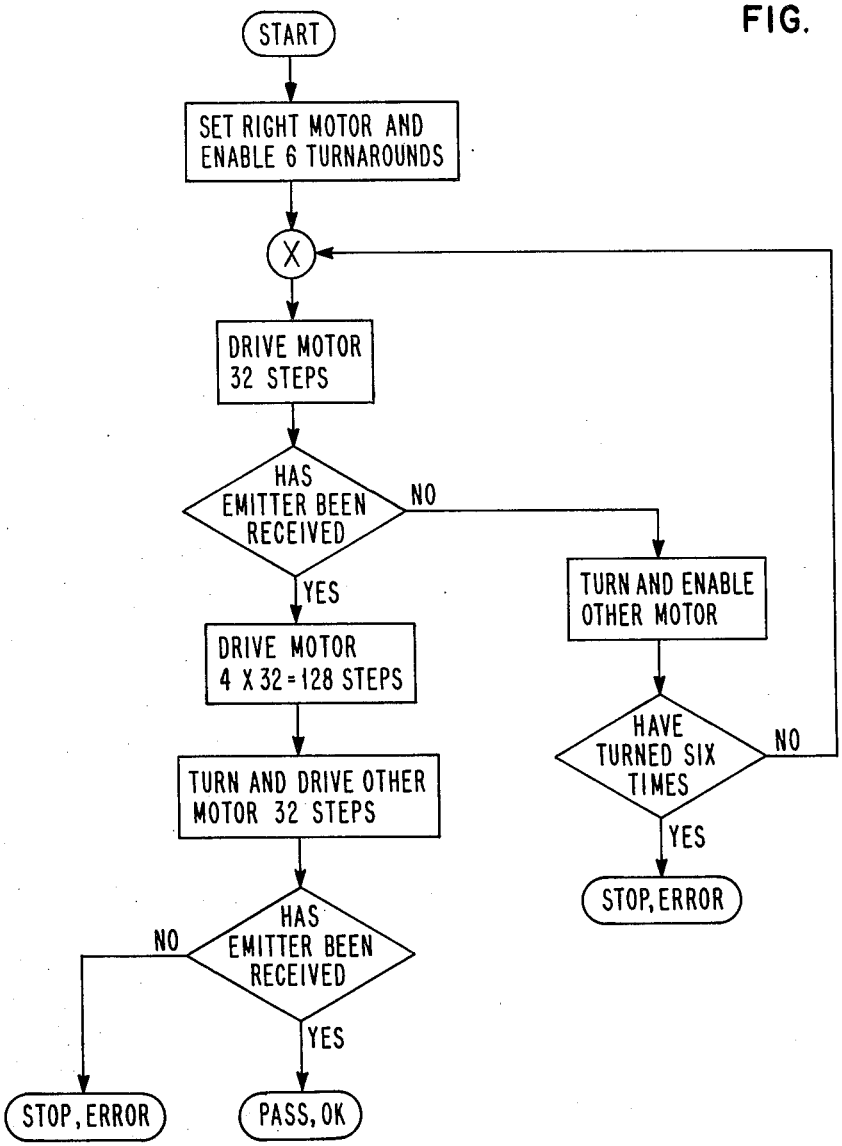
FIG. 11 illustrates a routine useful for ribbon slack removal and diagnostic error detection.

Provision is made in the Control and Drive circuits of FIG. 11 to enable removal of slack in the ribbon 41 with minimum stretching of the ribbon 41 and to provide a diagnostic verification test as part of the slack removal process. This would occur after loading of a new ribbon 41 or at Power on time, for example.

SUMMARY

Microcomputer 301 drives one motor 49 or 50 for thirty-two steps, each motor step corresponding to 2° rotation of the selected motor 49 or 50. If no emitter signals are received, then the driving action is reversed and the other motor 50 or 49 is driven for thirty-two steps, while the microcomputer 301 tests for emitter signals. This driving and reversing process continues until an emitter signal is received or six reversals have taken place. If a failure occurs this indicates that too much slack was present.

Once an emitter signal is received, the motor 49 or 50 which is driving continues driving $4\times32=128$ steps and then a reversal takes place. The other motor 50 or 49 drives for 32 steps and if no emitter signal is received then an error is present. If an emitter signal is received in this direction, then the test was passed.

By this scheme, emitter signals have been received in both directions verifying correct operation of the ribbon 41 and any slack has been removed without undue tension on the ribbon 41.

DETAILED DESCRIPTION—DIAGNOSTIC MOTION AND SLACK REMOVAL

The flowchart in FIG. 11 begins when the diagnostic mode is entered and at this time drive is enabled for one of the motors 49 or 50, such as the right motor 50 (FIG. 4) and a maximum of six turnarounds is permitted. Then the routine goes to Junction "X" and proceeds to actually drive the right motor 50 for thirty-two steps. These are arbitrary numbers of turnarounds and steps. Other values could be used if desired. As the right motor 50 drives, microcomputer 301 looks for emitter signals from the other motor, that is the left motor 49, in this case. A test is made to determine whether an emitter change has been detected. If no emitter change has been detected after driving the right motor 50 for thirty-two steps, a turnaround is enabled and drive of the other motor 49 is initiated. Then a decision is made to test and find out how many turnarounds have occurred. If six have occurred, this indicates that each motor 49 or 50 has been driven three times with thirty-two steps and there is undue slack in the ribbon 41 or no ribbon 41 at all. The ribbon 41 motion is stopped, and +Error line 315, FIG. 9, is activated. If less than six turnarounds have occurred, the routine returns to Junction "X" and begins driving the other motor 49 or 50, not previously selected. The routine continues in this loop until emitters have been received or six turnarounds have occurred. When at least one emitter signal has been received, that indicates that ribbon 41 is present and is on the spool 42 or 43 currently being driven. The motor 49 or 50 associated with that spool 42 or 43 is driven 128 steps ($4\times32$) which is again an arbitrary number chosen only to insure that there are enough emitter signals so that the difference in spool diameters has no effect on the final outcome. After 128 steps, a turnaround is initiated and the motor 49 or 50 which was being pulled is now driving and emitter signals are tested in the opposite direction. The motor 49 or 50 is now driven a full thirty-two steps to drive the ribbon 41 in that direction and a test is made to determine whether any emitter signals have been received for this direction. If no emitter signal has been received, that indicates that there has been an error and motion is stopped. If an emitter signal has been received, that indicates that at this state emitter signals have been received in both directions. There is ribbon 41 on the spool 42 or 43 and there are no problems in the ribbon system at this time.

This scheme provides for ribbon feeding from both spools 42 and 43 and, therefore, there is less tension on the ribbon 41. Slack, if present, is removed. Also, diagnostic testing of the ribbon drive and emitters in both directions is provided.

NORMAL RIBBON MOTION—SUMMARY

Figure 12:
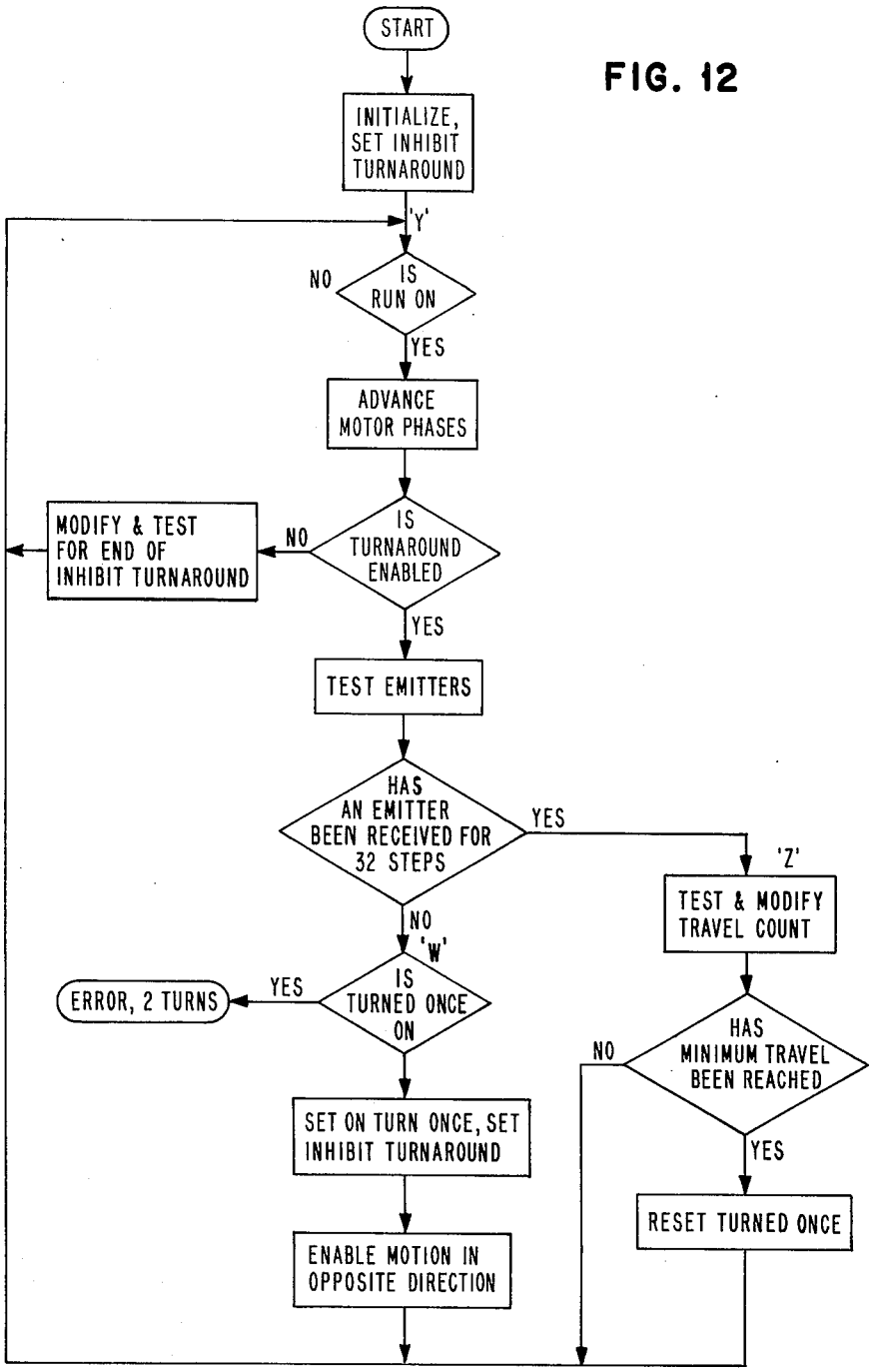
FIG. 12 is a routine used during normal ribbon drive operations.

Slack removal during normal ribbon drive operations provides an inhibit period after turnaround in which emitter changes are not tested. During this time one motor 49 or 50 is driving for a large number of steps in one direction. Referring to FIG. 12, the ribbon 41 is first initialized and turnaround inhibit is enabled, as an example, for 50 to 100 motor steps. When a run signal is received, the first motor phases are advanced and turnaround enable is tested. If turnaround is not enabled yet, then a test for end of inhibit of turnaround is done and control is returned to junction "Y".

When turnaround is enabled, emitter testing begins. If an emitter signal has been received within 32 motor steps, then control goes to junction "Z". There microcomputer 301 tests the distance traveled by the ribbon 41 since turnaround or starting. If a sufficient distance has been traveled, then a Turned Once indicator, not specifically illustrated but typically incorporated in microcomputer 301, is set off, no record of a previous turnaround is known and control goes to Junction "Y".

Junction "W" is reached if no emitter change was received for 32 motor steps. There a test is made to see if there has already been a turnaround (the Turned Once indicator is on). If so, then there have been two turnarounds within a short travel distance and a ribbon jam has occurred.

If no turnaround has recently been made, then this is the first and the Turned Once indicator is set, turnaround for a short turn sequence is inhibited, and motion is enabled in the opposite direction.

DETAILED DESCRIPTION—NORMAL RIBBON MOTION

FIG. 12 is a description of the normal ribbon motion sequence. At the outset, certain initialization procedures are performed and a Turnaround Inhibit indicator, not specifically illustrated but typically incorporated in microcomputer 301, is set. Then control proceeds to Junction "Y". The program will remain at this point until the ribbon motion is activated by turning on the Run line 310, FIG. 9. At this time, one of the motors 49 or 50 is advanced and a test is made to determine whether a possibility of making a turnaround is enabled. If the microprocomputer 301 is in a period in which turnaround is disabled, it will modify a disable count, test for the end of this turnaround disable time period and then return to Junction "Y". If turnaround is enabled, emitter testing will then proceed. Then a test is made to determine whether an emitter signal had been received within a time period of 32 motor steps. If an emitter signal has been received, then the program goes to Junction "Z". At Junction "Z", the program tests and modifies a ribbon travel count indicating the total ribbon motion. If this travel count has reached a certain value, generally in the neighborhood of ten yards of ribbon motion, which is comparable to approximately 16,000 motor steps, then the Turned Once indicator is reset and future ribbon turnarounds will not cause a ribbon jam. The program then goes to Junction "Y". If a turnaround is detected while the Turned Once indicator is on, then a ribbon jam is indicated. If no emitter signal had been received for 32 motor steps, the routine proceeds to Junction "W". At this point, the Turned Once indicator is tested. If this indicator is on, that indicates that two turnarounds have been detected within a small amount of ribbon travel and a ribbon jam is present. If this indicator is off, that indicates that this is a first turnaround or that it is a turnaround after a long distance of ribbon travel. The Turned Once indicator is then set on and the Turnaround Inhibit indicator is also set on. The motion of the other motor 49 or 50 is enabled and return is made to Junction "Y".

While a preferred embodiment of the invention has been illustrated and described, it is to be understood that there is no intention to limit the invention to the precise constructions herein disclosed and the right is reserved to all changes and modifications coming within the scope of the invention as defined in the appended claims.

We claim:

1. A ribbon control system for a printer unit having various assemblages for printing of characters on forms including a forms feed assembly and a print assembly, comprising:

a ribbon drive assembly in said printer unit including means to mount a pair of ribbon spools and motor drive means including a pair of ribbon drive motors individually associated with said ribbon spools, said ribbon spools and related motor drive means serving alternately as ribbon supply and ribbon takeup during printing operations;

means for mounting a ribbon on said spools for guiding past a print station in said printer unit; and a microcomputer interconnected directly with said ribbon drive motors and serving as a ribbon control element, said microcomputer issuing drive control signals as required in order to activate said ribbon drive motors on a selective and alternate basis during operations of said printer unit to thereby drive said ribbon between said ribbon spools and said microcomputer being further responsive to emitter signals provided by said motors to monitor for proper movement of said ribbon, and to perform other ribbon control functions such as diagnostics and ribbon slack removal.

2. The ribbon control system of claim 1, wherein:

said pair of ribbon drive motors comprise a pair of stepper motors, one stepper motor being individually connected to each of said ribbon spools and said stepper motors being alternately operable to drive their respective related ribbon spools responsive to said microcomputer drive control signals, each motor when not driving being pulled by the opposite motor by way of connection with said ribbon through the related ribbon spool of the motor not driving and providing emitter signals to said microcomputer to indicate ribbon movement.

3. The ribbon control system of claim 1 wherein:

said microcomputer provides drive signals to said ribbon drive motors on a selective basis during normal start-up and ribbon drive operations including ribbon turnaround operations and wherein said microcomputer is further operable to inhibit the sensing of emitter signals from the ribbon drive motor not activated for a predetermined number of motor steps upon such normal start-up of said ribbon driving or following any ribbon turnaround operation in order to remove slack in said ribbon.

4. The ribbon control system of claim 3, wherein:

said microcomputer is operable to provide signals to test for a minimum distance traveled by the ribbon since the last turnaround or since start-up during a normal ribbon feeding operation, the traveling of said minimum distance being indicative of satisfactory ribbon movement and wherein said microcomputer is further operable to provide signals to test for occurrence of at least two turnarounds within a minimum number of motor steps to detect a ribbon jam.

5. The ribbon control system of claim 1, wherein:

said microcomputer is operable upon each power-on or start-up occurrence of said printer unit to enable removal of slack with minimum stretching of the ribbon and to provide a diagnostic verification test by providing signals to drive and reverse said ribbon drive motors for at least a minimum number of ribbon reversals, the occurrence of such minimum number of reversals within a selected interval of time being indicative of the fact that too much slack is present in the ribbon.

6. The ribbon control system of claim 5, wherein:

said microcomputer is operable to check for the occurrence of at least one emitter signal during the diagnostic test, such occurrence being indicative that a ribbon is present on the ribbon spools in said printer unit.

7. The ribbon control system of claim 6 wherein said microcomputer is operable to test for the occurrence of emitter signals during movement of said ribbon in both directions.

8. The ribbon control system of claim 7 wherein the maximum number of ribbon reversals permitted is a value in the range of 6 indicating movement of each of said ribbon drive motors at least 3 times and wherein the maximum number of steps is in the range of 32 motor steps for each motor movement.

9. The ribbon control system of claim 8 wherein:

said microcomputer is operable to test for occurrence of at least one emitter signal indicative that ribbon is present on the ribbon spools, and wherein said microcomputer is further operable to provide drive signals to activate, said ribbon drive motors, on a selective basis for an arbitrary number of motor steps such as in the range of 128 in order to insure that no effect on the testing has occurred due to difference in diameter of ribbon on the individual ribbon spools.

* * * * *